US005854532A

United States Patent [19]

Kuwahara et al.

[11] Patent Number: 5,854,532

[45] Date of Patent: Dec. 29, 1998

[54] DEFLECTION YOKE DEVICE WITH IMPROVED COLOR SHIFT PROPERTIES

[75] Inventors: Yasunobu Kuwahara, Tamana; Katsuhiko Shiomi, Tamana-gun, both of Japan

[73] Assignee: Matsushita Electric Industrial Co., Ltd., Osaka, Japan

[21] Appl. No.: 683,387

[22] Filed: Jul. 18, 1996

[30] Foreign Application Priority Data

Jul. 21, 1995 [JP] Japan ..... 7-185228
Jun. 17, 1996 [JP] Japan ..... 8-155126

[51] Int. Cl.[6] ..... H01F 1/00; H01F 7/00

[52] U.S. Cl. ..... 313/440; 335/210; 335/213; 335/211

[58] Field of Search ..... 313/440; 315/370, 315/339–402; 335/210–215

[56] References Cited

U.S. PATENT DOCUMENTS

| | | | |
|---|---|---|---|
| 4,117,432 | 9/1978 | Shizu | 335/210 |
| 4,143,345 | 3/1979 | Barkow | 335/212 |
| 4,175,261 | 11/1979 | Sawada | 335/210 |
| 4,260,974 | 4/1981 | Nelle | 335/213 |
| 4,386,331 | 5/1983 | Kohzuki et al. | 335/211 |
| 4,553,120 | 11/1985 | Dam | 335/210 |
| 4,712,080 | 12/1987 | Katou | 335/213 |
| 4,939,415 | 7/1990 | Iwasaki et al. | 313/440 |
| 5,039,922 | 8/1991 | Ogasa et al. | 315/370 |
| 5,077,533 | 12/1991 | Klingelhofer | 335/213 |
| 5,138,290 | 8/1992 | Togane et al. | 335/210 |

*Primary Examiner*—Sandra O'Shea
*Assistant Examiner*—Matthew J. Gerike
*Attorney, Agent, or Firm*—Stevens, Davis, Miller & Mosher, L.L.P.

[57] ABSTRACT

A deflection yoke device includes vertical deflection coils wound on a pair of cores, respectively, and a pair of horizontal deflection coils each having two longitudinal portions connected to a larger arcuate interconnecting portion and a smaller arcuate interconnecting portion, respectively. The smaller arcuate interconnecting portion is connected generally perpendicularly to the longitudinal portions, respectively, and the larger arcuate interconnecting portion is connected at an acute angle to the longitudinal portions, respectively.

50 Claims, 11 Drawing Sheets

DEFLECTION YOKE DEVICE WITH IMPROVED COLOR SHIFT PROPERTIES

BACKGROUND OF THE INVENTION

This invention relates to a deflection yoke device combined with a cathode-ray tube used in a television receiver or the like.

BACKGROUND OF THE INVENTION

A conventional deflection yoke device will now be described with reference to the drawings. FIG. 14 is a cross-sectional view showing the conventional deflection yoke device. In FIG. 14, the deflection yoke device comprises a pair of horizontal deflection coils 1 having a saddle-like contour, a pair of cores 2 composed respectively of halves of a split ferrite member, and vertical deflection coils 3 wound respectively on the cores 2 in a toroidal manner.

FIG. 15 is a front-elevational view of the saddle-contoured horizontal deflection coil 1 of the conventional deflection yoke device. In FIG. 15, the saddle-contoured horizontal deflection coil 1 includes a pair of longitudinal portions 4, a larger arcuate interconnecting portion 5 interconnecting the two longitudinal portions 4 at an enlarged side, and a smaller arcuate interconnecting portion 6 interconnecting the two longitudinal portions 4 at a neck side.

The operation of electron beams in a horizontal deflection direction in the conventional deflection yoke device of the above construction will now be described. FIG. 16 schematically shows the electron beams in the horizontal deflection direction in the conventional deflection yoke device. In FIG. 16, the reference numeral 7 denotes a tube surface of a cathode-ray tube, 8 a central portion of the tube surface 7, 9 a blue electron gun, 10 a red electron gun, 11 blue electron beams emitted from the electron gun 9, and 12 red electron beams emitted from the electron gun 10. Although a green electron gun is also provided, this is not shown in the drawings. When deflecting these electron beams toward a peripheral portion of the tube surface 7 on a horizontal axis, a distance of the blue electron beam 11 to a phosphor screen and a distance of the red electron beam 12 to the phosphor screen become different from each other as the blue and red electron beams 11 and 12 shift from the central portion 8 toward the peripheral portion, and an ignition plane 14, in which image points 13, formed by the intersection of the blue electron beam 11 and the red electron beam 12 are connected to one another, becomes progressively away from the tube surface 7 toward the peripheral portion. Therefore, a correction amount 15 for correcting a convergence deviation is needed at the peripheral portion of the tube surface 7.

Therefore, in the horizontal deflection coils 1, in order to achieve the correction amount 15 of the convergence at the peripheral portions of the tube surface 7, a horizontal deflection magnetic field is formed into a pin-cushion distribution, and a deflection magnetic field force F is exerted to urge the blue electron beams 11 and the red electron beams 12 away from one another in opposite directions indicated by arrows 16, thereby suppressing a color shift of the convergence of the blue electron beams 11 and the red electron beams 12, occurring at the peripheral portion of the tube surface 7, to within an allowable value.

Thus, in the conventional deflection yoke device, the color shift of the convergence of the blue electron beams 11 and the red electron beams 12 at the peripheral portion of the tube surface 7 can be suppressed to within the allowable value. However, at this time, the correction by the deflection magnetic field force F becomes excessive at an intermediate portion of the tube surface 7, so that a color shift of the convergence occurs. Therefore, if the color shift at the intermediate portion is corrected in such a manner that a slight color shift of the convergence remains at the peripheral portion, there develops such a color shift that with respect to the convergence at the peripheral portion and the intermediate portion on the horizontal axis X (see FIG. 17), the pattern of the red electron beams 12, disposed on the right side at the peripheral portion, is disposed at the left side at the intermediate portion. Another problem is that the horizontal deflection efficiency can not be enhanced while maintaining the characteristics.

SUMMARY OF THE INVENTION

It is an object of this invention to provide a deflection yoke device which enhances a horizontal deflection efficiency, and eliminates a color shift of a convergence at a peripheral portion and an intermediate portion of a tube surface.

The above object of the invention has been solved by a deflection yoke device comprising vertical deflection coils wound on a pair of cores respectively; and a pair of horizontal deflection coils each having two longitudinal portions connected to a larger arcuate interconnecting portion and a smaller arcuate interconnecting portion, respectively; the smaller arcuate interconnecting portion being connected generally perpendicularly to the longitudinal portions, respectively, and the larger arcuate interconnecting portion being connected at an acute angle to the longitudinal portions, respectively.

In this invention, there is provided a deflection yoke device in which a horizontal deflection efficiency is enhanced, and a color shift of a convergence at a peripheral portion and an intermediate portion of a tube surface is eliminated.

In one aspect of the present invention, there is provided a deflection yoke device comprising vertical deflection coils wound on a pair of cores, respectively; and a pair of horizontal deflection coils each having two longitudinal portions connected to a larger arcuate interconnecting portion and a smaller arcuate interconnecting portion; the smaller arcuate interconnecting portions being connected generally perpendicularly to the longitudinal portions, respectively, and the larger arcuate interconnecting portion being connected at an acute angle to the longitudinal portions, respectively. In this device, advantageously, inductance of the horizontal deflection coils is reduced, a gap between the smaller arcuate interconnecting portion and the larger arcuate interconnecting portion in the longitudinal direction increases progressively from a tube axis toward the longitudinal portions, and a length of a region, at which a deflecting magnetic field is exerted, increases progressively from the center thereof toward an outer side.

In another aspect of the invention, there is provided a deflection yoke device comprising vertical deflection coils wound on a pair of cores, respectively; and a pair of horizontal deflection coils, of which two longitudinal portions are connected to a larger arcuate interconnecting portion and a smaller arcuate interconnecting portion to assume a saddle-like contour; the smaller arcuate interconnecting portion being connected generally perpendicularly to the two longitudinal portions, respectively, and the larger arcuate interconnecting portion being connected at an acute angle to the two longitudinal portions, respectively. In this device, advantageously, an inductance of the horizontal deflection coils is reduced, a gap between the smaller arcuate interconnecting portion and the larger arcuate interconnecting portion in the longitudinal direction increases progressively from a tube axis toward the longitudinal portions, and a length of a region, at which a deflecting magnetic field is exerted, increases progressively from the center thereof toward an outer side.

In a further aspect of the invention, there is provided the deflection yoke device, in which the cores are arch-shaped to diverge in a longitudinal direction and to be increased in a longitudinal length progressively toward a core peak at a diverging side, and the pair of cores are butted together, with their concave sides opposed to each other, to assume a shape like a bell of a trumpet, and in which the pair of horizontal deflection coils are butted together with the longitudinal portions thereof opposed to each other, and positions where the longitudinal portions are butted together are registered with positions of the core peaks in a circumferential direction. In this device, advantageously, the core has an increased cross-sectional area in the longitudinal direction according to the increased longitudinal length thereof at the core peak position, and therefore magnetic saturation of the cores is less liable to occur, so that a magnetic flux is increased.

In a further aspect of the invention, there is provided a deflection yoke device comprising a pair of cores; a pair of horizontal deflection coils each having two first longitudinal portions connected to a first larger arcuate interconnecting portion and a first smaller arcuate interconnecting portion; and a pair of vertical deflection coils each having two second longitudinal portions connected to a second larger arcuate interconnecting portion and a second smaller arcuate interconnecting portion; the first smaller arcuate interconnecting portion being connected generally perpendicularly to the first longitudinal portions, respectively, the first larger arcuate interconnecting portion being connected at an acute angle to the first longitudinal portions, respectively, and the second smaller arcuate interconnecting portion and the second larger arcuate interconnecting portion being connected generally perpendicularly to the second longitudinal portion, respectively. In this device, advantageously, inductance of the horizontal deflection coils is reduced, and a length of a region, at which a deflection magnetic field is exerted, increases progressively from the center of the deflecting magnetic field toward outer sides, and therefore an angle θ of deflection of electron beams is increased.

According to a further aspect of the invention, there is provided a deflection yoke device comprising a pair of cores; a pair of horizontal deflection coils each having two first longitudinal portions connected to a first larger arcuate interconnecting portion and a first smaller arcuate interconnecting portion to assume a saddle-like contour; and a pair of vertical deflection coils each having two second longitudinal portions connected to a second larger arcuate interconnecting portion and a second smaller arcuate interconnecting portion to assume a saddle-like contour; the first smaller arcuate interconnecting portion being connected generally perpendicularly to the first longitudinal portions, respectively, the first larger arcuate interconnecting portion being connected at an acute angle to the first longitudinal portions, respectively, and the second smaller arcuate interconnecting portion and the second larger arcuate interconnecting portion being connected generally perpendicularly to the second longitudinal portion, respectively. In this device, advantageously, inductance of the horizontal deflection coils is reduced, and a length of a region, at which a deflection magnetic field is exerted, increases progressively from the center of the deflecting magnetic field toward outer sides, and therefore an angle θ of deflection of electron beams is increased.

In a further aspect of the invention, there is provided the deflection yoke device in which the cores are arch-shaped to diverge in a longitudinal direction and to be increased in a longitudinal length progressively toward a core peak at diverging side, and the pair of cores are butted together, with their concave sides opposed to each other, to assume a shape like a bell of a trumpet, and in which the pair of horizontal deflection coils are butted together with the first longitudinal portions thereof opposed to each other and positions where the first longitudinal portions are butted together are registered with positions of the core peaks in a circumferential direction. In this device, advantageously, the core has an increased cross-sectional area in the longitudinal direction according to the increased longitudinal length thereof at the core peak position, and therefore magnetic saturation of the cores is less liable to occur, so that a magnetic flux is increased.

In a further aspect of the invention, there is provided the deflection yoke device, in which the larger arcuate interconnecting portion has a polygonal shape which is approximated by a plurality of straight lines. In this device, advantageously, inductance of the horizontal deflection coils is reduced, and a length of the region, at which the deflection magnetic field is exerted, increases progressively from the center of the deflecting magnetic field toward the outer sides, and the angle θ of deflection of electron beams toward the peripheral portion is increased.

In a further aspect of the invention, there is provided the deflection yoke device, in which the first larger arcuate interconnecting portion has a polygonal shape which is approximated by a plurality of straight lines. In this device, advantageously, inductance of the horizontal deflection coils is reduced, and a length of the region, at which the deflection magnetic field is exerted, increases progressively from the center of the deflecting magnetic field toward the outer side, and the angle θ of deflection of electron beams toward the peripheral portion is increased.

In a further aspect of the invention, there is provided the deflection yoke device according, in which a thickness of the larger arcuate interconnecting portion in a radial direction is generally equal to a thickness of the longitudinal portions in a radial direction. In this device, advantageously, inductance of the horizontal deflection coils is reduced, and a length of the region, at which the deflection magnetic field is exerted, increases progressively from the center of the deflecting magnetic field toward the outer side, and the angle θ of deflection of electron beams toward the peripheral portion is increased.

In a further aspect of the invention, there is provided the deflection yoke device, in which a thickness of the first larger arcuate interconnecting portion in a radial direction is generally equal to a thickness of the first longitudinal portions in a radial direction. In this device, advantageously, inductance of the horizontal deflection coils is reduced, and a length of the region, at which the deflection magnetic field is exerted, increases progressively from the center of the deflecting magnetic field toward the outer side, and the angle θ of deflection of electron beams toward the peripheral portion is increased.

In a further aspect of the invention, there is provided the deflection yoke device, in which a thickness of the smaller arcuate interconnecting portion in a radial direction is generally equal to a thickness of the longitudinal portions. In this device, advantageously, inductance of the horizontal deflection coils is reduced.

In a further aspect of the invention, there is provided the deflection yoke device, in which a thickness of the first smaller arcuate interconnecting portion in a radial direction is generally equal to a thickness of the first longitudinal portions. In this device, advantageously, inductance of the horizontal deflection coils is reduced.

DESCRIPTION OF THE PREFERRED EMBODIMENTS

Preferred embodiments of the present invention will now be described with reference to FIGS. 1 to 13.

Figure 1:
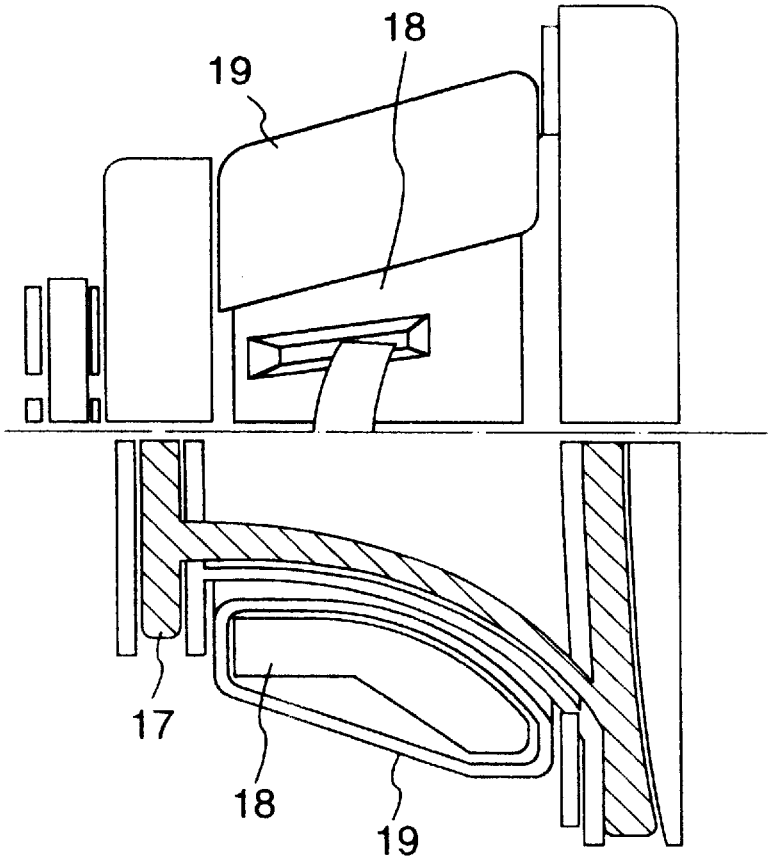
FIG. 1 is a cross-sectional view of a deflection yoke device according to a first embodiment of the present invention.

FIG. 1 shows a first embodiment of a deflection yoke device of the invention. In FIG. 1, the deflection yoke device comprises a pair of horizontal deflection coils 17 having a saddle-like contour, a pair of cores 18 made of ferrite, and vertical deflection coils 19 wound respectively on the cores 18 in a toroidal manner. The cores 18 are composed of halves of a split member, respectively, and have an arch-shaped cross-section to diverge in the longitudinal direction. The cores 18 are substantially equal in length to each other, and the cores 18, when butted together in opposed relation to each other, assume a shape like a bell of a trumpet.

Figure 2:
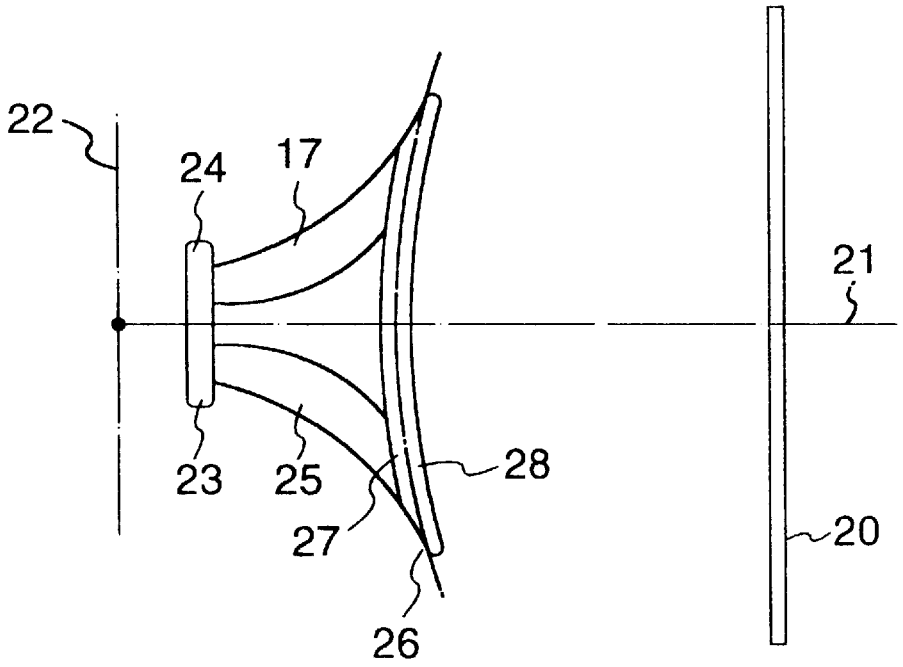
FIG. 2 is a front-elevational view of a horizontal deflection coil of the deflection yoke device of the first embodiment.
Figure 3:
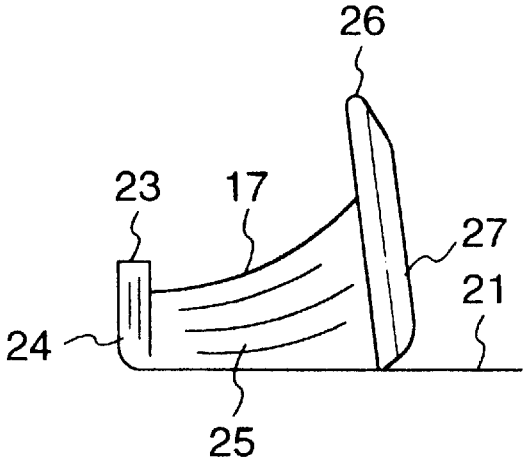
FIG. 3 is a side-elevational view of the horizontal deflection coil of the deflection yoke device of the first embodiment.

FIG. 2 is a front-elevational view of the horizontal deflection coil of the deflection yoke device of the first embodiment, and FIG. 3 is a side-elevational view of the horizontal deflection coil of the deflection yoke device of the first embodiment. In FIGS. 2 and 3, the reference numeral 20 denotes a tube surface of a cathode-ray tube, and 21 an axis (tube axis) of the tube surface 20, and the horizontal deflection coil 17 is formed around this tube axis. With respect to the winding of the horizontal deflection coil 17, the winding is started from a smaller arcuate interconnecting portion 24 of a horseshoe-shape at a neck side 23 in parallel relation to a tube axis plane 22 perpendicular to the tube axis 21, and then the winding proceeds sequentially through one of two longitudinal portions 25, a larger arcuate interconnecting portion 27 of a horseshoe-shape at an enlarged side 26, and the other longitudinal portion 25, and then the winding is again made at the smaller arcuate interconnecting portion 24 at the neck side 23. This winding operation is repeated to form the horizontal deflection coil 17 which comprises the two longitudinal portions 25 interconnected by the larger arcuate interconnecting portion 27 and the smaller arcuate interconnecting portion 24, the horizontal deflection coil 17 thus formed assuming a saddle-like contour.

At this time, the larger arcuate interconnecting portion 27 is formed into a horseshoe-shape 28 around the tube axis 21, and the smaller arcuate interconnecting portion 24 is connected generally perpendicularly to the two longitudinal portions 25. The larger arcuate interconnecting portion 27 is connected at an acute angle to the two longitudinal portions 25. Namely, the larger arcuate interconnecting portion 27 is connected in an inclined manner (that is, inclined toward the smaller arcuate interconnecting portion 24) to the two longitudinal portions 25. When the larger arcuate interconnecting portion 27 is thus connected at the acute angle to the two longitudinal portions 25, the length of the winding of the larger arcuate interconnecting portion 27 is reduced, so that an inductance of the horizontal deflection coil 17 is reduced. A gap between the smaller arcuate interconnecting portion 24 and the larger arcuate interconnecting portion 27 in the longitudinal direction increases progressively from the tube axis 21 toward each longitudinal portion 25.

Figure 4:
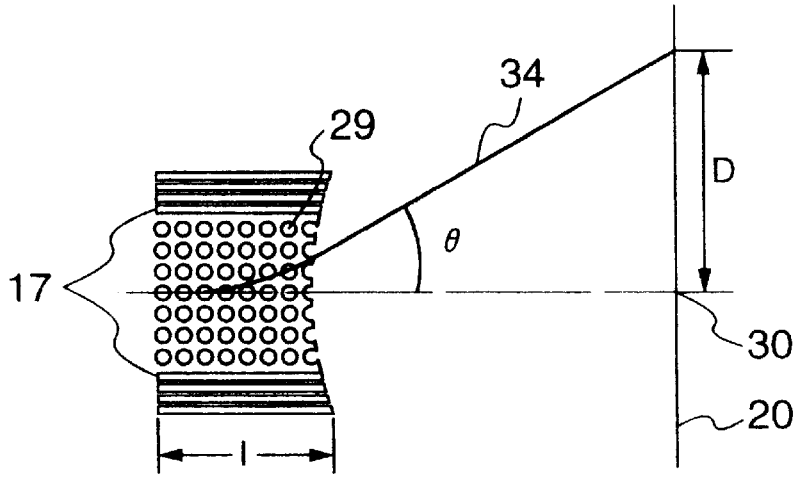
FIG. 4 is a schematic view showing a deflection magnetic field, produced by the horizontal deflection coils of the deflection yoke device of the first embodiment, and electron beams.
Figure 5:
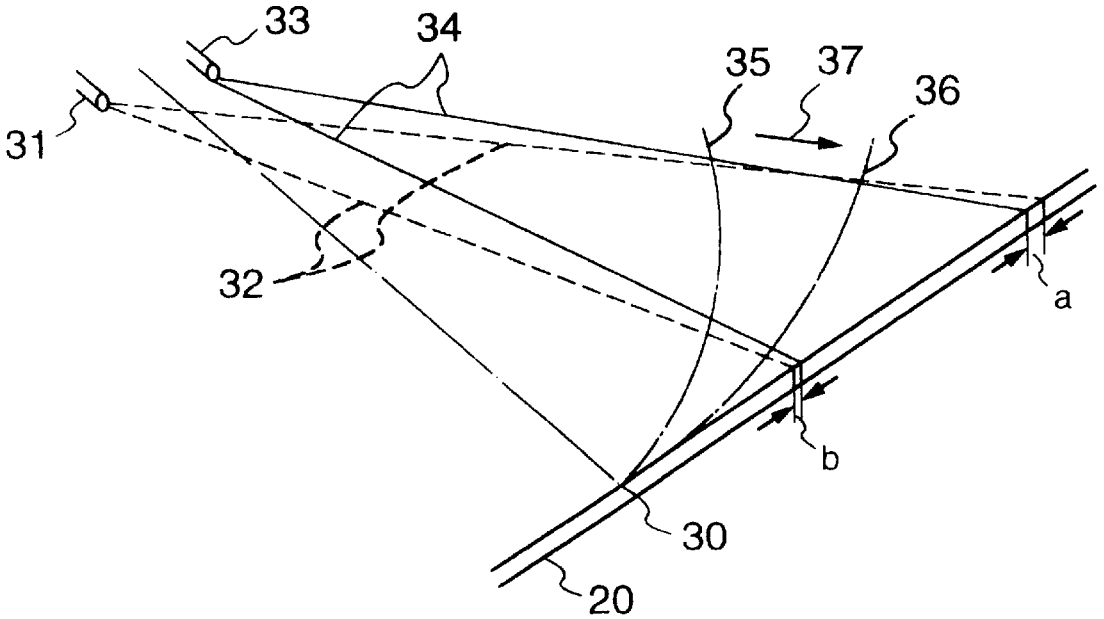
FIG. 5 is a schematic view showing the electron beams in the horizontal deflection coils of the deflection yoke device of the first embodiment.

An action of electron beams in a horizontal deflection direction in the deflection yoke device of this construction will now be described. FIG. 4 schematically shows a deflecting magnetic field of the horizontal deflection coils of the deflection yoke device of the first embodiment, as well as the electron beams. FIG. 5 schematically shows electron beams of the horizontal deflection coils of the deflection yoke device of the first embodiment. In FIGS. 4 and 5, the reference numeral 29 denotes a deflecting magnetic field produced by the horizontal deflection coils 17, 30 a central portion of the tube surface 20, 31 a blue electron gun, 32 blue electron beams emitted from the blue electron gun 31, 33 a red electron gun, and 34 red electron beams emitted from the red electron gun 33. A green electron gun and a green electron beam are not shown in the drawings.

A gap between the smaller arcuate interconnecting portion 24 and the larger arcuate interconnecting portion 27 in the longitudinal direction increases progressively from the tube axis 21 toward each longitudinal portion 25 (see FIG. 2), and therefore a length l of a region, at which the deflecting magnetic field 29, produced by the horizontal deflection coils 17, is exerted, increases progressively from the center toward the outer side as shown in FIG. 4, so that an angle θ of deflection of the red electron beams 34 increases, thereby increasing its deflecting amount D.

Referring to a peripheral portion of the tube surface 20, the red electron beams 34 are deflected by the deflecting magnetic field 29 produced by the horizontal deflection coils 17, and passes through that portion of the magnetic field region which is disposed outwardly of the center, and is larger in region length l than the center, so that these red electron beam 34 are directed toward the tube surface 20 at an increased deflection angle θ. Similarly, the blue electron beams 32 are deflected by the deflecting magnetic field 29. At this time, the blue electron beam 32 passes through that portion of the magnetic field region which is disposed inwardly of that portion of the magnetic field region through which the red electron beam 34 passes, and is smaller in region length l than that portion of the magnetic field region through which the red electron beam 34 passes. Therefore, the blue electron beams 32 are directed toward the tube surface 20 at the deflection angle θ which is smaller that the deflection angle θ of the red electron beams 34. Thus, the deflecting magnetic field 29 is produced by the horizontal deflection coils 17, and in accordance with the length l of the region at which the deflecting magnetic field 29 is exerted, the angle θ of deflection of the red electron beams 34 is increased while the angle of deflection of the blue electron beams 32 is not so large. Therefore, in the present invention, an ignition plane 36 (at which the red and blue electron beams intersect each other) is shifted closer to the tube surface 20 than the conventional ignition plane 35, as indicated by arrow 37, so that a color shift a of the convergence can be kept to within an allowable value.

At the intermediate portion of the tube surface 20, the red electron beams 34 pass through that portion of the region of the deflecting magnetic field 29 produced by the horizontal deflection coils 17, which is smaller in region length l than that portion of the magnetic field region through which the red electron beams 34 pass toward the peripheral portion, and are directed toward the tube surface 20. Similarly, the blue electron beams 34 pass through that portion of the region of the magnetic field region which is smaller in region length l than that portion of the magnetic field region through which the blue electron beams 32 pass toward the peripheral portion, and are directed toward the tube surface 20. Therefore, the angle θ of deflection of the red electron beams 34 is smaller at the intermediate portion than at the peripheral portion. Similarly, the angle θ of deflection of the blue electron beams 32 is smaller at the intermediate portion than at the peripheral portion, and therefore an amount of shift of the ignition plane 36, at which the red and blue electron beams 34 and 32 intersect each other, toward the tube surface 20 in the direction of arrow 27 is smaller at the intermediate portion than at the peripheral portion, and therefore a color shift b of the convergence can be kept to within an allowable value.

In the deflection yoke device of the first embodiment of the present invention, a length of the winding of the larger arcuate interconnecting portion 27 is reduced, and an inductance of the horizontal deflection coil 17 is reduced, whereby the horizontal deflection efficiency can be enhanced. And besides, since a gap between the smaller arcuate interconnecting portion 24 and the larger arcuate interconnecting portion 27 of the horizontal deflection coil 17 in the longitudinal direction increases progressively from the tube axis 21 toward each longitudinal portion 25, the length l of the region, at which the deflecting magnetic field 29, produced by the horizontal deflection coils 17, is exerted, increases progressively from the center of the deflecting magnetic field 29 toward the outer side, so that the angle θ of deflection of the electron beams increases, to increase the deflection amount D, whereby the convergence color shift a at the peripheral portion, as well as the convergence color shift b at the intermediate portion, is kept to within the allowable value to enhance the grade of the convergence of the tube surface 20.

Figure 6:
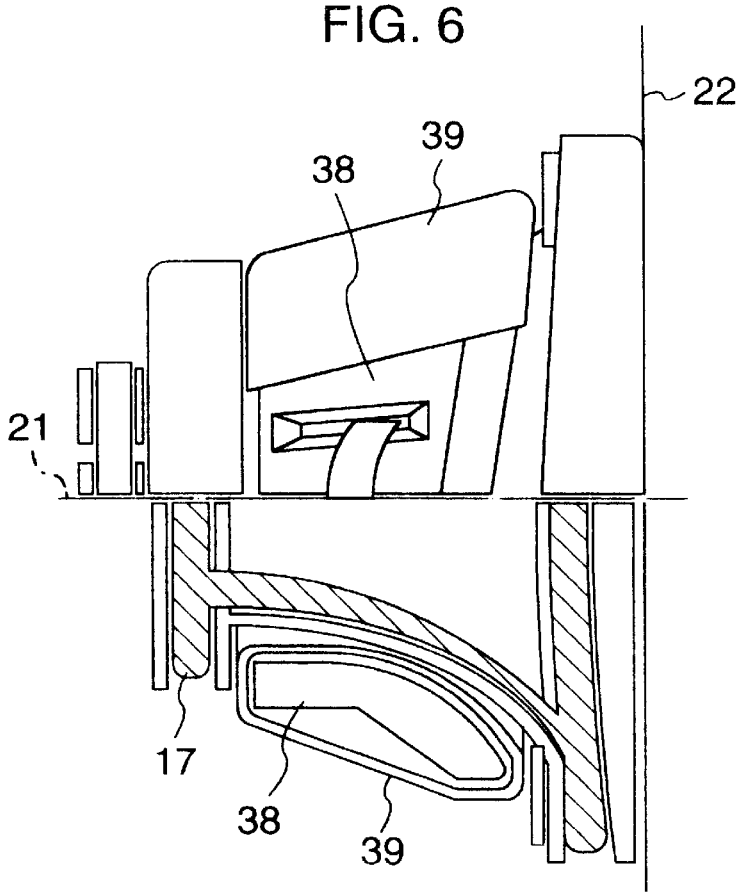
FIG. 6 is a cross-sectional view of a deflection yoke device according to a second embodiment of the invention.

FIG. 6 is a cross-sectional view of a deflection yoke device according to a second embodiment of the invention. In FIG. 6, elements designated by the same reference numerals as in the first embodiment are basically identical to elements of the first embodiment, respectively. In FIG. 6, the deflection yoke device comprises a pair of horizontal deflection coils 17 having a saddle-like contour, a pair of cores 38 made of ferrite, and vertical deflection coils 39 wound respectively on the cores 38 in a toroidal manner. The cores 38 are composed of halves of a split member, respectively, and have an arch-shaped cross-section diverging in the longitudinal direction, and a longitudinal length of each core 38 increases progressively toward a core peak at a diverging side. The cores 38, when butted together with their concave sides opposed to each other, assume a shape like a bell of a trumpet. The core peak means a top of the arch-shape. When the cores 38 are butted together, end surfaces of the cores 38 at a neck side are disposed in a plane perpendicular to a tube axis 21. The horizontal deflection coil 17 is the same as that of the first embodiment shown in FIG. 2.

As shown in FIG. 6, each of the cores 38 has an arch-shaped cross-section diverging in the longitudinal direction, that is, in the direction of the tube axis 21, and the longitudinal length of each core 38 increases progressively toward the core peak at the opened side. The cores 38 are butted together with their concave sides opposed to each other, so that the cores 38 assume a shape like a bell of a trumpet. The pair of horizontal deflection coils 17 are butted together in such a manner that longitudinal portions 25 of the respective coils 17 are opposed to each other, and the positions of butting of the longitudinal portions 25 are registered with the positions of the core peaks in the peripheral direction. A conductive wire serving as the vertical deflection coil 39 is wound on each of the cores 38.

Thus, positions of butting of the longitudinal portions 25 of the horizontal deflection coils 17 are registered with positions of the core peak in a circumferential direction, whereby an inductance of the horizontal deflection coils 17 is reduced, and those portions of a magnetic field region, at which a deflecting magnetic field of the horizontal deflection coils 17 is exerted, having the largest length coincide with those portions of the cores 38 having the largest longitudinal length. The core 38 has an increased cross-sectional area in the longitudinal direction because of the increased longitudinal length thereof, and therefore magnetic saturation of the cores 38 is reduced. Even if a magnetic flux of the deflecting magnetic field is increased at the position where the region length of the horizontal deflection coils 17 is the largest, a satisfactory action can be achieved.

An action of the horizontal deflection coils 17 of the deflection yoke device of the second embodiment will now be described. An action in this embodiment is generally similar to that in the first embodiment shown in FIGS. 4 and 5. Those portions of the region, at which the deflecting magnetic field 29 of the horizontal deflection coils 17 is exerted, and which have the largest length, coincide with those portions of the cores 38 having the increased longitudinal cross-sectional area, and therefore when the horizontal deflection coils 17 produce the deflecting magnetic field 29 and electron beams are deflected to be directed toward a peripheral portion of a tube surface 20, magnetic saturation of the cores 38 due to the deflecting magnetic field 29 produced by the horizontal deflection coils 17 is less liable to occur, and the deflected magnetic flux is increased to enhance the deflection efficiency. Therefore, the electron beams can be permitted to act satisfactorily.

With respect to an action of the vertical deflection coils 39, each core 38 has an increased longitudinal cross-sectional area according to the increased longitudinal length thereof at the core peak, and therefore magnetic saturation of the cores 38 is less liable to occur in a deflecting magnetic field produced by the vertical deflection coils 39, whereby the temperature rise of the cores 38 is decreased to enable stabilizing an action of the electron beams.

Figure 7:
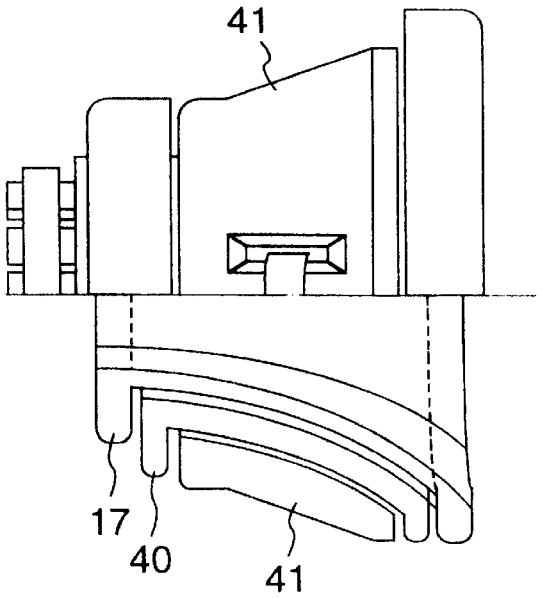
FIG. 7 is a cross-sectional view of a third embodiment of a deflection yoke device of the invention.

FIG. 7 is a cross-sectional view of a deflection yoke device according to a third embodiment of the invention. In FIG. 7, the deflection yoke device comprises a pair of horizontal deflection coils 17 having a saddle-like contour, a pair of vertical deflection coils 40 having a saddle-like contour, and a pair of cores 41 of ferrite arranged to generally cover the vertical deflection coils 40. The cores 41 are composed of halves of a split member, respectively, and have an arch-shaped cross-section diverging in the longitudinal direction. The cores 41 are substantially equal in length to each other, and, when butted together in opposed relation to each other, assume a shape like a bell of a trumpet.

The horizontal deflection coils 17 are similar in shape to those of the first embodiment. More specifically, each of the pair of saddle-contoured horizontal deflection coils 17 includes two first longitudinal portions 25 interconnected by a first larger arcuate interconnecting portion 27 and a first smaller arcuate interconnecting portion 24. The first smaller arcuate interconnecting portion 24 is connected generally perpendicularly to the first longitudinal portions 25, respectively and the first larger arcuate interconnecting portion 27 is connected at an acute angle to the first longitudinal portions 25, respectively. With this construction, an inductance of the horizontal deflection coils 17 is reduced.

Figure 8:
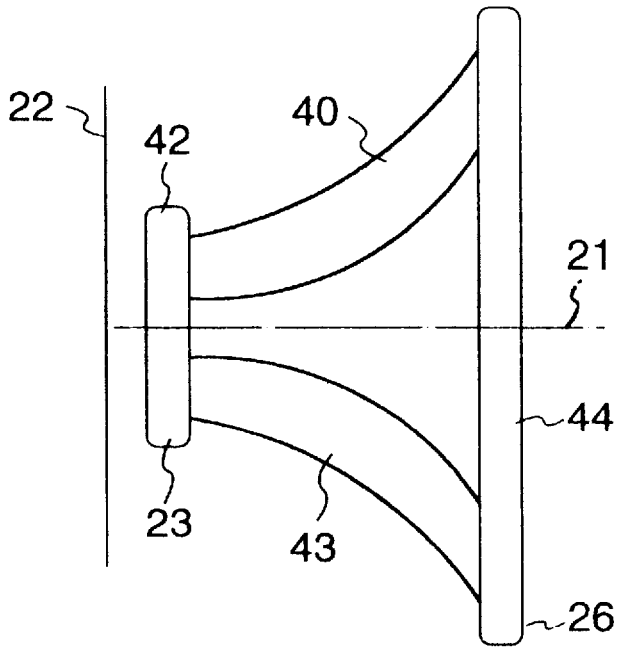
FIG. 8 is a front-elevational view of a vertical deflection coil of the deflection yoke device of the third embodiment.

Reference is now made to the vertical deflection coils 40. FIG. 8 is a front-elevational view of the vertical deflection coil of the deflection yoke device of the third embodiment. As shown in FIG. 8, with respect to the winding of the vertical deflection coil 40, the winding is started from a second smaller arcuate interconnecting portion 42 of a horseshoe-shape at a neck side 23 in parallel to a tube axis plane 22 perpendicular to a tube axis 21, and then the winding proceeds sequentially through one of two second longitudinal portions 43, a second larger arcuate interconnecting portion 44 of a horseshoe-shape at a diverged side 26, and the other second longitudinal portion 43. Then the winding is again made at the second smaller arcuate interconnecting portion 42 at the neck side 23. This winding operation is repeated to form the vertical deflection coil 40.

Thus, the vertical deflection coil 40 is constructed such that the two second longitudinal portions 43 are interconnected to the second larger arcuate interconnecting portion 44 and the second smaller arcuate interconnecting portion 42, thus assuming the saddle-like contour, and the second smaller arcuate interconnecting portion 42 and the second larger arcuate interconnecting portion 44, respectively, are connected generally perpendicularly to the two second longitudinal portions 43.

The pair of vertical deflection coils 40 are butted together in such a manner that the second longitudinal portions 43 of these coils 40 are opposed to each other, and positions where the second longitudinal portions 43 are butted together are registered in the peripheral direction with positions where the cores 41 are butted together with their concave sides opposed to each other, thereby assuming a bell of a trumpet. The pair of horizontal deflection coils 17 are butted together with the first longitudinal portions 25 of these coils 17 opposed to each other, and positions where the first longitudinal portions 25 are butted together are registered with the positions of core peaks of the cores 41 in a circumferential direction.

In the deflection yoke device constructed in this manner, an action of electron beams is generally the same as that of the first embodiment shown in FIGS. 4 and 5. More specifically, the horizontal deflection coils 17 produce a deflecting magnetic field 29, and a region at which the deflecting magnetic field 29 is exerted increases in length progressively from the center of the deflecting magnetic field 29 toward the outer sides, so that an angle $\theta$, at which electron beams are deflected increases, thereby increasing a deflection amount D. Therefore, similar effects as achieved in the first embodiment can be obtained.

Figure 9:
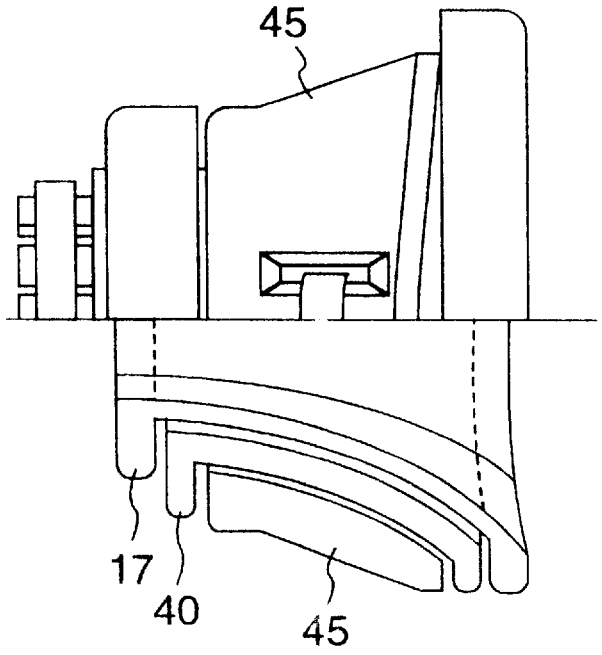
FIG. 9 is a cross-sectional view of a deflection yoke device according to a fourth embodiment of the invention.

FIG. 9 is a cross-sectional view of a deflection yoke device according to a fourth embodiment of the invention. In the deflection yoke device of FIG. 9, a pair of horizontal deflection coils 17 having a saddle-like contour as described above in the first embodiment are provided, and a pair of vertical deflection coils 40 having a saddle-like contour as described above in the third embodiment are provided. Further, a pair of cores 45 formed of ferrite and composed respectively of halves of a split member, are provided to cover the vertical deflection coils 40.

As shown in FIG. 9, in the fourth embodiment, the cores 45 are arch-shaped to diverge in the longitudinal direction that is, in a direction of a tube axis 21, and are constructed to be increased in a longitudinal length progressively toward a core peak at a diverging side. The cores 45 are butted together with their concave sides opposed to each other to assume a shape like a bell of a trumpet. The pair of horizontal deflection coils 17 are butted together with longitudinal portions 25 thereof 17 opposed to each other, and positions where the longitudinal portions 25 are butted together are registered in a circumferential direction with positions of the core peaks of the core 45.

Thus, the positions where the longitudinal portions 25 are butted together coincide with the positions of the core peaks of the cores 45 in the incumferential direction whereby an inductance of the horizontal deflection coils 17 is reduced, and those portions of a magnetic field region, at which a deflecting magnetic field of the horizontal deflection coils 17 is exerted, and which have the largest length, coincide with those portions of the cores 45 which have the largest longitudinal length. As the cores 45 have an increased cross-sectional area in the longitudinal direction according to an increased in the longitudinal length thereof, magnetic saturation of the cores 45 is reduced, and even if a magnetic flux of the deflecting magnetic field is increased at positions where the region length of the horizontal deflection coils 17 is the largest, the satisfactory operation can be achieved.

An action of the horizontal deflection coils 17 of the deflection yoke device of the fourth embodiment will now be described. This action is generally similar to that of the first embodiment shown in FIGS. 4 and 5. As in the second embodiment, those portions of the region, at which the deflecting magnetic field 29, produced by the horizontal deflection coils 17, is exerted, and which have the largest length coincide with those portions of the cores 45 which have the increased longitudinal cross-sectional area. So, when electron beams are deflected and directed toward a peripheral portion of a tube surface 20, magnetic saturation of the cores 45 due to the deflecting magnetic field 29, produced by the horizontal deflection coils 17, is less liable to occur, and the deflecting magnetic flux can be increased to enhance the deflection efficiency. Therefore, the electron beams can be made to act satisfactorily.

In the action of the vertical deflection coils 40, the cores 45 have the increased longitudinal cross-sectional area according to the increased longitudinal length thereof at the core peak, whereby magnetic saturation of the cores 45 is less liable to occur in a deflecting magnetic field produced by the vertical deflection coils 40, and the temperature rise of the cores 45 is correspondingly decreased to enable stabilizing the action of the electron beams.

Figure 10:
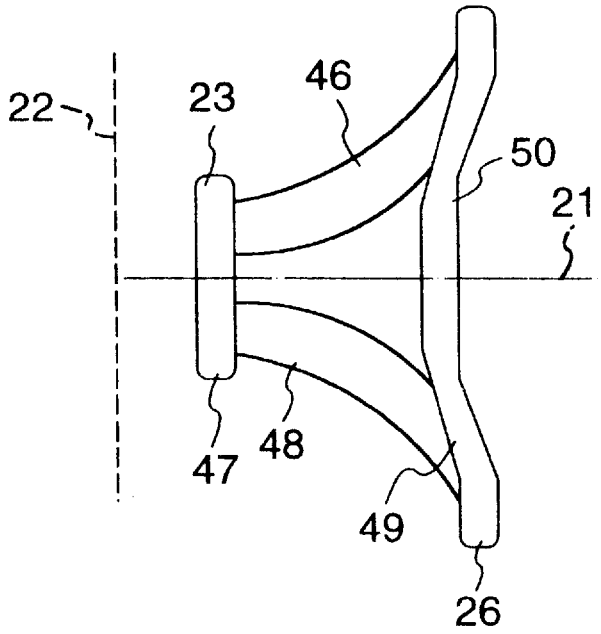
FIG. 10 is a front-elevational view of a horizontal deflection coil of a deflection yoke device according to a fifth embodiment of the invention.

FIG. 10 is a front-elevational view of a horizontal deflection coil of a deflection yoke device according to a fifth embodiment of the invention. In FIG. 10, the reference numeral 46 denotes a horizontal deflection coil having a saddle-like contour. With respect to winding of the horizontal deflection coil 46, the winding is started from a smaller arcuate interconnecting portion 47 of a horseshoe-shape at a neck side 23 in parallel to a tube axis plane 22 perpendicular to a tube axis 21, and then proceeds sequentially through one of two longitudinal portions 48, a larger arcuate interconnecting portion 49 of a horseshoe-shape at a diverging side 26, and the other longitudinal portion 48. Then the winding is again made at the smaller arcuate interconnecting portion 47 at the neck side 23. This winding operation is repeated to form the horizontal deflection coil 47.

In this case, the larger arcuate interconnecting portion 49 is generally polygonal to assume an approximately horseshoe-shape 50 similar to a horseshoe-shape. More specifically, the generally polygonal, approximately horseshoe-shape 50 is defined by a plurality of straight lines combined together into a shape approximating to a polygonal shape. The smaller arcuate interconnecting portion 47 is connected generally perpendicularly to the two longitudinal portions 48, and the larger arcuate interconnecting portion 49 is connected at an acute angle to the two longitudinal portions 48, respectively. The approximately horseshoe-shape 50 can be easily formed, and a gap between the smaller arcuate interconnecting portion 47 and the larger arcuate interconnecting portion 49 in the longitudinal direction increases progressively from the tube axis 21 toward each longitudinal portion 48. With this construction, inductance of the horizontal deflection coils 46 is reduced.

An action of electron beams in the deflection yoke device of the fifth embodiment is generally similar to that of the first embodiment shown in FIGS. 4 and 5. More specifically, the larger arcuate interconnecting portion 49 is connected at an acute angle to the two longitudinal portions 48, respectively, and a gap between the smaller arcuate interconnecting portion 47 and the larger arcuate interconnecting portion 49 in the longitudinal direction increases progressively from the tube axis 21 toward each longitudinal portion 48, whereby a length of a region, at which a deflecting magnetic field 29, produced by the horizontal deflection coils 46, is exerted, increases progressively from the center of the deflecting magnetic field toward the outer side. Therefore, an angle θ of deflection of electron beams toward a peripheral portion of a tube surface 20 increases, so that an ignition plane, at which the electron beams intersect each other, is shifted closer to the tube surface 20. Thus, similar effects as achieved in the first embodiment can be obtained.

In the fifth embodiment, the larger arcuate interconnecting portion 49 is formed into the generally polygonal, approximately horseshoe-shape 50. The larger arcuate interconnecting portion 27 of the horizontal deflection coil 17 in the first and second embodiments and the first larger arcuate interconnecting portion 27 of the horizontal deflection coil 17 in the third and fourth embodiments may be formed into such a generally polygonal, approximately horseshoe-shape 50, in which case similar effects can be obtained.

Figure 11A:
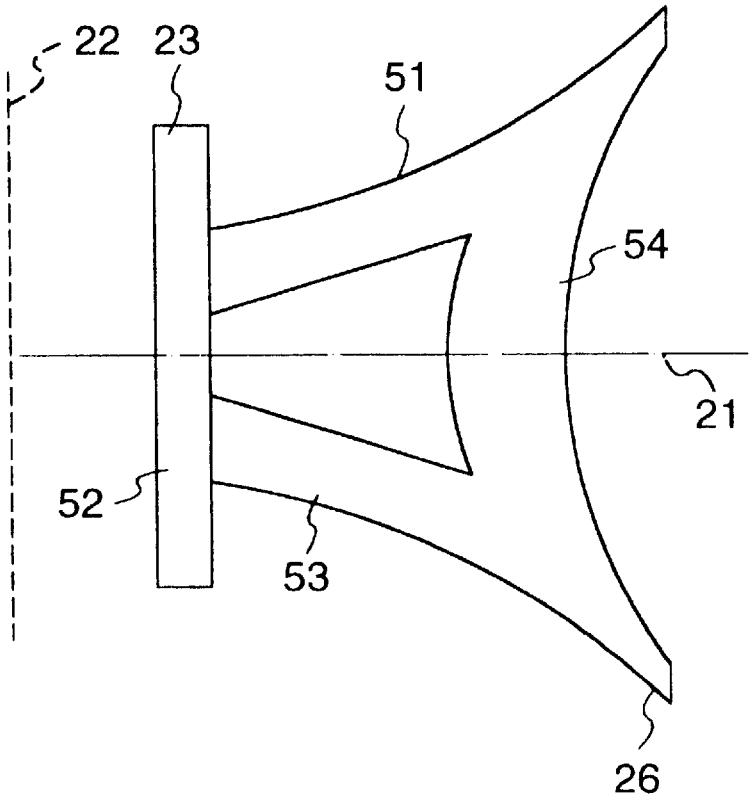
FIG. 11A is a front-elevational view of a horizontal deflection coil of a deflection yoke device according to a sixth embodiment of the invention.
Figure 11B:
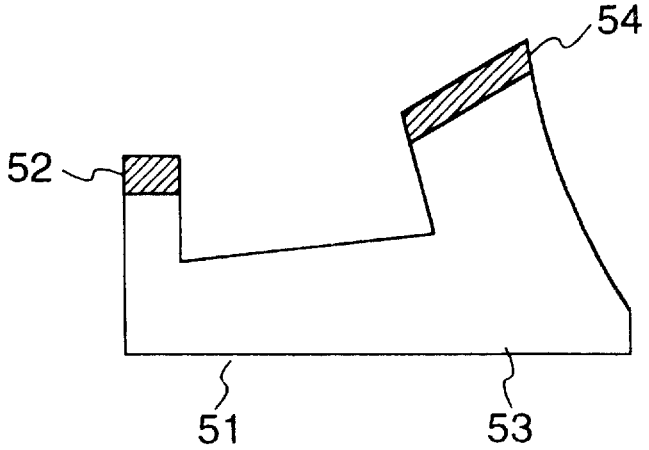
FIG. 11B is a cross-sectional view of the horizontal deflection coil in the deflection yoke device of the sixth embodiment.

FIG. 11A is a front-elevational view of a horizontal deflection coil of a deflection yoke device according to a sixth embodiment of the invention, and FIG. 11B is a cross-sectional view of the horizontal deflection coil in the deflection yoke device of the sixth embodiment. In FIGS. 11A and 11B, the reference numeral 51 denotes a horizontal deflection coil. With respect to winding of the horizontal deflection coil 51, the winding is started from a smaller arcuate interconnecting portion 52 of a horseshoe-shape at a neck side 23 in parallel to a tube axis plane 22 perpendicular to a tube axis 21, and then proceeds sequentially through one of two longitudinal portions 53, a larger arcuate interconnecting portion 54 of a horseshoe-shape at a diverging side 26, and the other longitudinal portion 53. Then the winding is again made at the smaller arcuate interconnecting portion 52 at the neck side 23. This winding operation is repeated to form the horizontal deflection coil 51.

A thickness of the larger arcuate interconnecting portion 54 in a radial direction is generally equal to a thickness of the longitudinal portion 53 in a radial direction at the diverging side 26, and the smaller arcuate interconnecting portion 52 is connected generally perpendicularly to the two longitudinal portions 53, respectively. The larger arcuate interconnecting portion 54 is connected obliquely toward the smaller arcuate interconnecting portion 52 to the two longitudinal portions 53. A gap between the smaller arcuate interconnecting portion 52 and the larger arcuate interconnecting portion 54 in the longitudinal direction increases progressively from the tube axis 21 toward the longitudinal portions 53. Therefore, the winding length about the larger arcuate interconnecting portion 54 is shortened to reduce an inductance of the horizontal deflection coils 51.

An action of electron beams in the deflection yoke device of the sixth embodiment is generally similar to that of the first embodiment shown in FIGS. 4 and 5. More specifically, the larger arcuate interconnecting portion 54 is connected to the two longitudinal portions 53 obliquely toward the smaller arcuate interconnecting portion 52, and a gap between the smaller arcuate interconnecting portion 52 and the larger arcuate interconnecting portion 54 in the longitudinal direction increases progressively from the tube axis 21 toward each longitudinal portion 53, and therefore a length of a region at which a deflection magnetic field 29, produced by the horizontal deflection coils 51, is exerted increases progressively from the center of the deflection magnetic field toward the outer side. Therefore, an angle θ of deflection of electron beams toward a peripheral portion of a tube surface 20 increases, so that an ignition plane (at which the electron beams intersect each other) is shifted closer to the tube surface 20. Thus, similar effects as achieved in the first embodiment can be obtained.

In the sixth embodiment, a thickness of the larger arcuate interconnecting portion 54 in the radial direction is generally equal to that of the longitudinal portions 53 in the radial direction at the diverging side 26. The larger arcuate interconnecting portion 27 of the horizontal deflection coil 17 in the first and second embodiment and the first larger arcuate interconnecting portion 27 of the horizontal deflection coil 17 of the third and fourth embodiments may be made generally equal in thickness in the radial direction to the longitudinal portion at the diverging side, in which case similar effects as achieved with this arrangement of the sixth embodiment can be obtained.

Figure 12A:
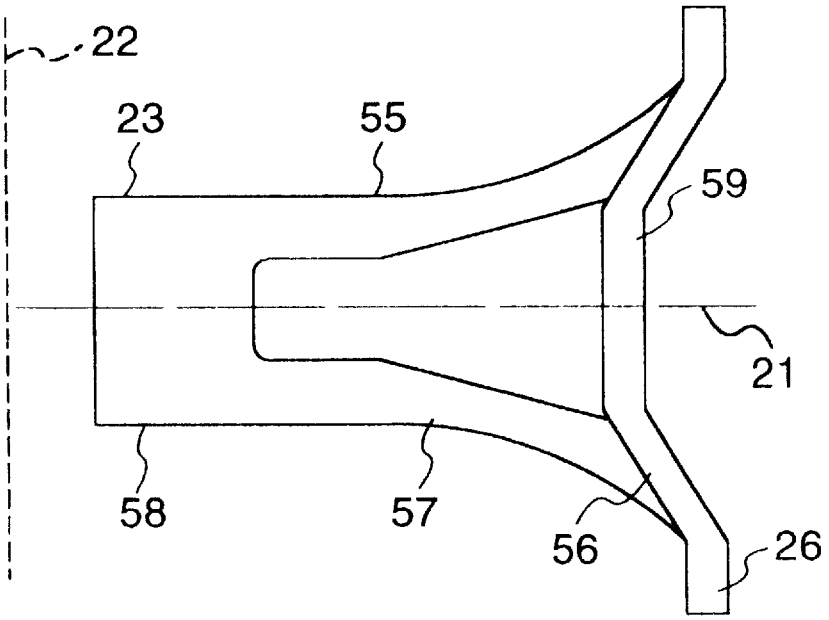
FIG. 12A is a front-elevational view of a horizontal deflection coil of a deflection yoke device according to a seventh embodiment of the invention.
Figure 12B:
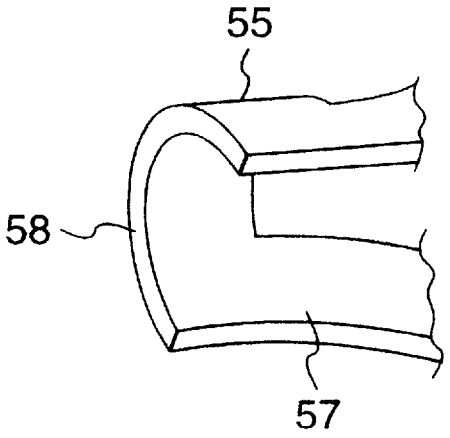
FIG. 12B is a perspective view of a portion of the horizontal deflection coil in the deflection yoke device of the sixth embodiment.

FIG. 12A is a front-elevational view of a horizontal deflection coil of a deflection yoke device according to a seventh embodiment of the invention, and a FIG. 12B is a perspective view of a portion of the horizontal deflection coil in the deflection yoke device of the seventh embodiment. In FIGS. 12A and 12B, the reference numeral 55 denotes a horizontal deflection coil. With respect to winding of the horizontal deflection coil 55, the winding is started from a larger arcuate interconnecting portion 56 of a horseshoe-shape at a diverging side 26 in parallel to a tube axis plane 22 perpendicular to a tube axis 21, and then proceeds sequentially through one of two longitudinal portions 57, a smaller arcuate interconnecting portion 58 of a horseshoe-shape at a neck side 23, and the other of the longitudinal portion 57. Then the winding is again made at the larger arcuate interconnecting portion 56 at the diverging side 26. This winding operation is repeated to form the horizontal deflection coil 55.

In this case, the larger arcuate interconnecting portion 56 is generally polygonal to assume an approximately horseshoe-shape 59 approximating to a horseshoe-shape. More specifically, the generally polygonal, approximate horseshoe-shape 59 is defined by a plurality of straight lines combined together into a shape approximating to a polygonal shape. The smaller arcuate interconnecting portion 58 is connected generally perpendicularly to the longitudinal portions 57, respectively, and a thickness of the smaller arcuate interconnecting portion 58 in a radial direction is generally equal to that of the longitudinal portions 57 in a radial direction at the neck portion 23. The larger arcuate interconnecting portion 56 is connected at an acute angle to the longitudinal portions 57, respectively. An inductance of the horizontal deflection coils 55 is reduced. The approximate horseshoe-shape 59 can be easily formed, and a gap between the smaller arcuate interconnecting portion 58 and the larger arcuate interconnecting portion 56 in the longitudinal direction increases progressively from the tube axis 21 of the longitudinal portions 57 toward each longitudinal portions 57.

An action of electron beams in the deflection yoke device of the seventh embodiment is generally similar to that of the first embodiment shown in FIGS. 4 and 5. More specifically, the larger arcuate interconnecting portion 56 is connected at an acute angle to the longitudinal portions 57, respectively, and a gap between the smaller arcuate interconnecting portion 58 and the larger arcuate interconnecting portion 56 in the longitudinal direction increases progressively from the tube axis 21 toward the longitudinal portions 57. Therefore, a length of a region, at which a deflecting magnetic field 29, produced by the horizontal deflection coils 55, is exerted, increases progressively from the center of the deflecting magnetic field toward the outer sides. Therefore, an angle θ of deflection of electron beams toward a peripheral portion of a tube surface 20 increases, so that an ignition plane, at which the electron beams intersect each other, is shifted closer to the tube surface 20. Thus, similar effects as achieved in the first embodiment can be obtained.

Figure 13A:
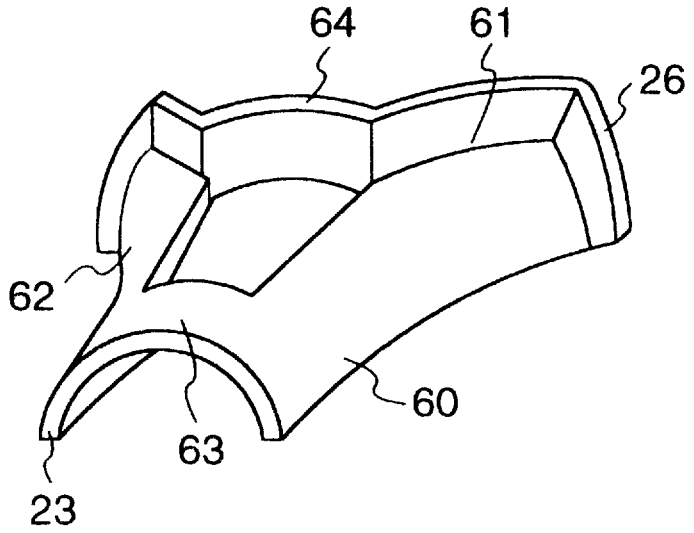
FIG. 13A is a perspective view of a modified horizontal deflection coil in the deflection yoke device of the seventh embodiment.
Figure 13B:
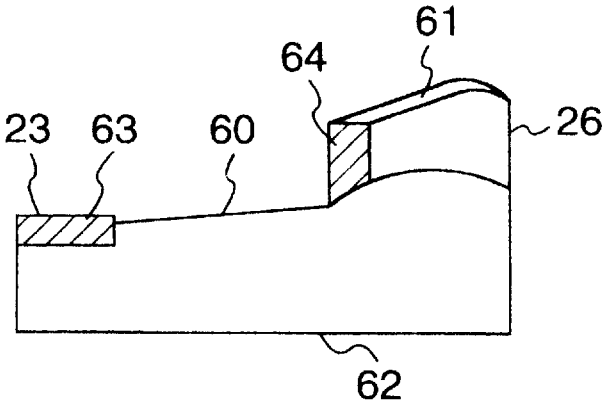
FIG. 13B is a cross-sectional view of the horizontal deflection coil in the deflection yoke device of the seventh embodiment.
Figure 14:
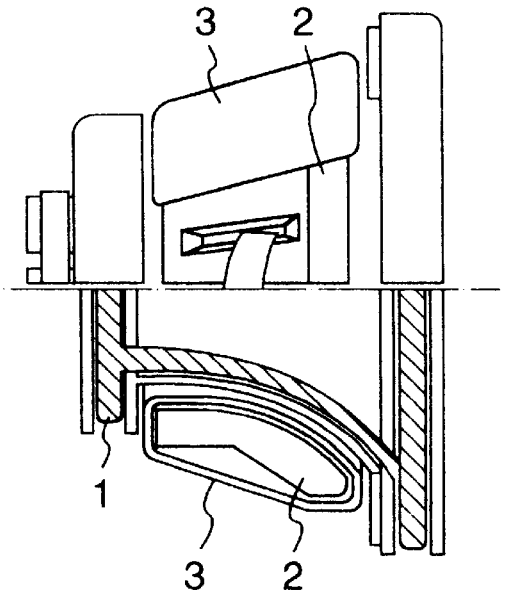
FIG. 14 is a cross-sectional view of a conventional deflection yoke device.
Figure 15:
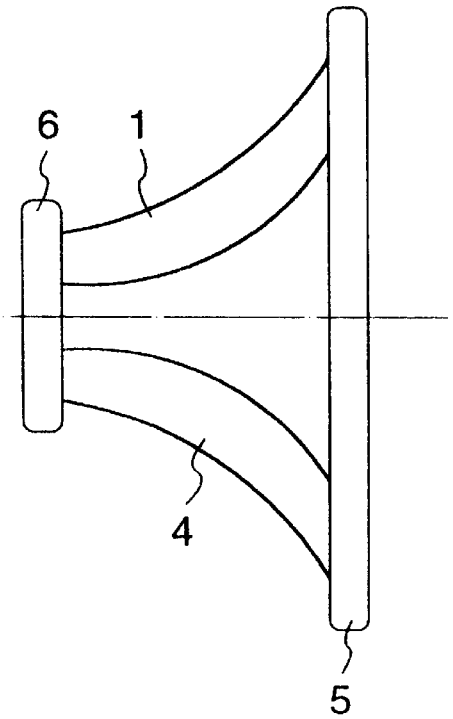
FIG. 15 is a front-elevational view of a saddle-contoured horizontal deflection coil in the conventional deflection yoke device.
Figure 16:
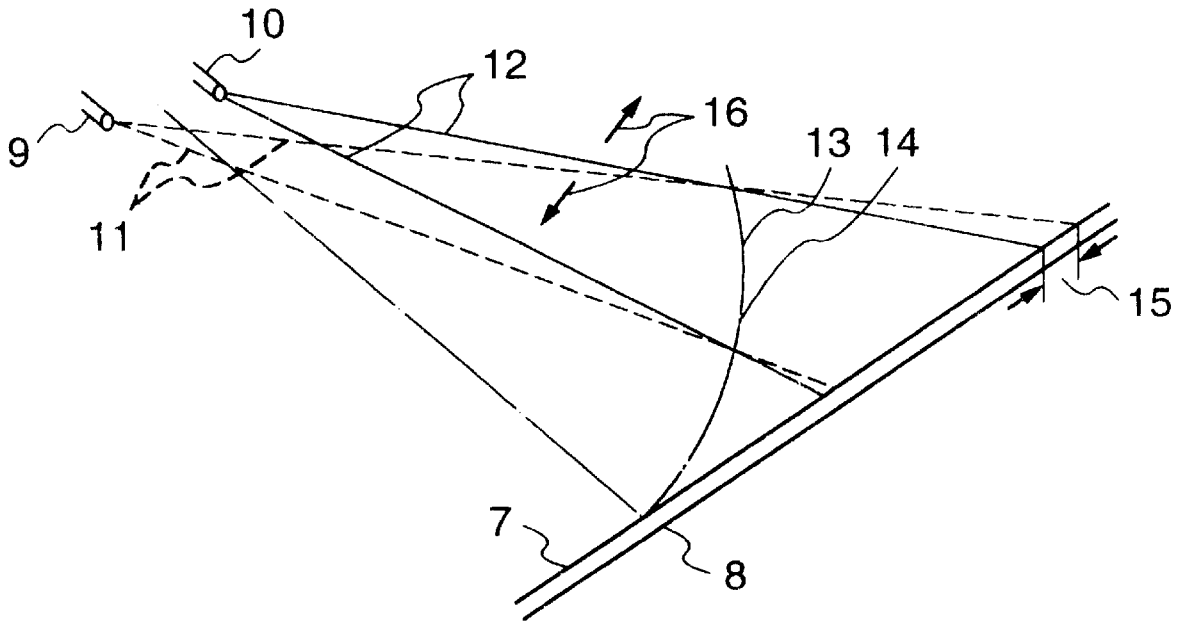
FIG. 16 is a schematic view showing electron beams in a horizontal deflection direction in the conventional deflection yoke device.
Figure 17:
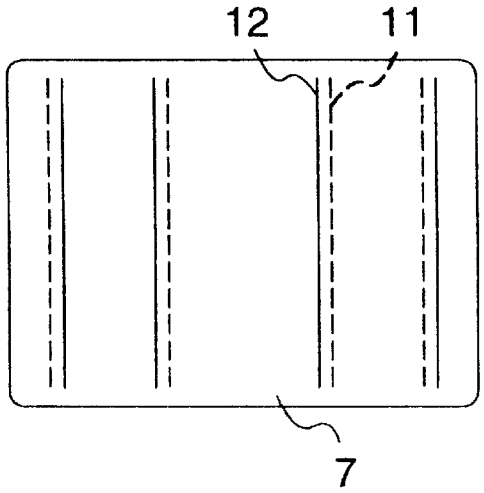
FIG. 17 is a view showing a horizontal convergence image plane in a cathode-ray tube in the conventional deflection yoke device.

In the seventh embodiment, the larger arcuate interconnecting portion 56 of the horizontal deflection coil 55 assumes the generally polygonal, approximately horseshoe-shape 59 defined by the plurality of straight lines combined together into a shape approximating to a polygonal shape. Similar effects can be attained in the case where the horizontal deflection coil is formed as shown in FIGS. 13A and 13B. FIG. 13A is a perspective view of a horizontal deflection coil in the deflection yoke device of the seventh embodiment of the invention, and FIG. 13B is a cross-sectional view of the horizontal deflection coil. In FIGS. 13A and 13B, the reference numeral 60 denotes a horizontal deflection coil. With respect to winding of the horizontal deflection coil 60, the winding is started from a larger arcuate interconnecting portion 61 of a horseshoe-shape at a diverging side 26, and then proceeds sequentially through one of two longitudinal portions 62, a smaller arcuate interconnecting portion 63 of a horseshoe-shape at a neck side 23, and the other of the longitudinal portions 62. Then the winding is again made at the larger arcuate interconnecting portion 61 at the diverging side 26. This winding operation is repeated to form the horizontal deflection coil 60.

In this case, the larger arcuate interconnecting portion 61 assumes an approximate horseshoe-shape 64 which is approximated by polygonal and arcuate shapes. More specifically, the approximate horseshoe-shape 64 is defined by a plurality of straight lines combined together into a shape approximating to a polygonal shape, and also a central portion of this approximate horseshoe-shape 64 is arcuate to be spaced away from the smaller arcuate interconnecting portion 63. The smaller arcuate interconnecting portion 63 is connected generally perpendicularly to the two longitudinal portions 62, respectively, and a thickness of the smaller arcuate interconnecting portion 63 in a radial direction is generally equal to that of the longitudinal portions 62 in a radial direction at the neck portion 23. The larger arcuate interconnecting portions 61 are connected at an acute angle to the two longitudinal portions 62, respectively. This approximate horseshoe-shape 64 of the larger arcuate interconnecting portion 61 is included in the approximate horseshoe-shape 59 shown in FIGS. 12A and 12B.

In the seventh embodiment, the thickness of the smaller arcuate interconnecting portion 58 in the radial direction is generally equal to that of the longitudinal portions 57 in the radial direction at the neck portion 23. The thickness of the smaller arcuate interconnecting portion 24 of the horizontal deflection coil 17 in the first and second embodiments in the radial direction, and the thickness of the first smaller arcuate interconnecting portion 24 of the horizontal deflection coil 17 in the third and fourth embodiments in the radial direction, may be made generally equal to that of the longitudinal portion 25 in the radial direction at the neck portion 23, in which case similar effects as attained in the seventh embodiment can be obtained. In the seventh embodiment, the larger arcuate interconnecting portion 56 assumes the approximate horseshoe-shape 59 which is approximated by a polygonal shape. The larger arcuate interconnecting portion 27 of the horizontal deflection coil 17 in the first and second embodiments and the first larger arcuate interconnecting portion 27 of the horizontal deflection coil 17 in the third and fourth embodiments may assume an approximate horseshoe-shape which is approximated by a polygonal shape. In such case similar effects as attained by the generally polygonal, approximate horseshoe-shape 59 can be obtained.

As described above, in the deflection yoke device of the present invention, winding of the larger arcuate interconnecting portion is reduced in length to decrease inductance of the horizontal deflection coils, and to enhance the horizontal deflection efficiency. And besides, a gap between the smaller arcuate interconnecting portion and the larger arcuate interconnecting portion in the longitudinal direction increases progressively from the tube axis toward the longitudinal portions, so that a length of a region, at which the deflecting magnetic field is exerted, increases progressively from the center of the deflecting magnetic field toward the outer sides, and an angle θ of deflection of electron beams is made large to increase the deflection amount. Thus the ignition plane of electron beams is shifted closer to the image plane to enable eliminating the color shift of the convergence at the peripheral portion and the intermediate portion.

In the deflection yoke device of the invention, the cores are shaped such that the longitudinal length of the cores increases progressively toward the core peak, and are butted together, with their concave sides opposed to each other, to assume a bell of a trumpet, and positions where the longitudinal portions of the horizontal deflection coils butted together are registered with positions of the core peaks in the circumferential direction. Therefore, the cores will have an increased longitudinal cross-sectional area according to the increased length thereof in the longitudinal direction. With this construction, magnetic saturation of the cores is less liable to occur, the temperature rise of the cores is reduced, and the deflection efficiency is enhanced.

What is claimed is:

1. A deflection yoke device comprising:

a pair of cores;

vertical deflection coils wound on said pair of cores, respectively; and a pair of horizontal deflection coils each having a larger arcuate interconnecting portion, a smaller arcuate interconnecting portion and two longitudinal portions connected to said larger arcuate interconnecting portion and said smaller arcuate interconnecting portion;

said smaller arcuate interconnecting portions being connected generally perpendicularly to said longitudinal portions, respectively, and said larger arcuate interconnecting portions being connected at an acute angle to said longitudinal portions, respectively.

2. A deflection yoke device comprising:

a pair of cores;

vertical deflection coils wound on said pair of cores, respectively; and a pair of horizontal deflection coils, each having two longitudinal portions, a larger arcuate interconnecting portion and a smaller arcuate interconnecting portion, wherein said two longitudinal portions are connected to said larger arcuate interconnecting portion and said smaller arcuate interconnecting portion to assume a saddle-like contour;

wherein, in each of said pair of horizontal deflection coils, said smaller arcuate interconnecting portion is connected generally perpendicularly to said two longitudinal portions, respectively, and said larger arcuate interconnecting portion is connected at an acute angle to said two longitudinal portions, respectively.

3. A deflection yoke device according to claim 1, wherein said cores are arch-shaped to diverge in a longitudinal direction and to be increased in a longitudinal direction and to be increased in a longitudinal length progressively toward a core peak of each of said cores at a diverging side, and said pair of cores are butted together, with concave sides of said cores opposed to each other, to assume a shape like a bell of a trumpet, and wherein said pair of horizontal deflection coils are butted together with said longitudinal portions opposed to each other, and positions where said longitudinal portions are butted together are registered with positions of said core peaks in a circumferential direction.

4. A deflection yoke device comprising:

a pair of cores;

a pair of horizontal deflection coils each having two first longitudinal portions connected to a first larger arcuate interconnecting portion and a first smaller arcuate interconnecting portion; and a pair of vertical deflection coils each having two second longitudinal portions connected to a second larger arcuate interconnecting portion and a second smaller arcuate interconnecting portion;

said first smaller arcuate interconnecting portion in each of said pair of horizontal deflection coils being connected generally perpendicularly to said first longitudinal portions, respectively;

said first larger arcuate interconnecting portion in each of said pair of horizontal deflection coils being connected at an acute angle to said first longitudinal portions, respectively; and said second smaller arcuate interconnecting portion and said second larger arcuate interconnecting portion in each of said pair of vertical deflection coils being connected generally perpendicularly to said second longitudinal portions, respectively.

5. A deflection yoke device comprising:

a pair of cores;

a pair of horizontal deflection coils, each having a first larger arcuate interconnecting portion, a first smaller arcuate interconnecting portion and two first longitudinal portions connected to said first larger arcuate interconnecting portion and said first smaller arcuate interconnecting portion to assume a saddle-like contour; and a pair of vertical deflection coils, each having a second larger arcuate interconnecting portion, a second smaller arcuate interconnecting portion and two second longitudinal portions connected to said second larger arcuate interconnecting portion and said second smaller arcuate interconnecting portion to assume a saddle-like contour;

said first smaller arcuate interconnecting portion in each of said pair of horizontal deflection coils being connected generally perpendicularly to said first longitudinal portions, respectively;

said first larger arcuate interconnecting portion in each of said pair of horizontal deflection coils being connected at an acute angle to said first longitudinal portions, respectively; and said second smaller arcuate interconnecting portion and said second larger arcuate interconnecting portion in each of said pair of vertical deflection coils being connected generally perpendicularly to said second longitudinal portions, respectively.

6. A deflection yoke device according to claim 4, wherein said cores are arch-shaped to diverge in a longitudinal direction and to be increased in a longitudinal length progressively toward a core peak of each of said cores at a diverging side, and said pair of cores are butted together, with concave sides of said cores opposed to each other, to assume a shape like a bell of a trumpet, and wherein said pair of horizontal deflection coils are butted together with said first longitudinal portions opposed to each other, and positions where said first longitudinal portions are butted together are registered with positions of said core peaks in a circumferential direction.

7. A deflection yoke device according to claim 1, wherein said larger arcuate interconnecting portion has a polygonal shape which is approximated by a plurality of straight lines.

8. A deflection yoke device according to claim 4, wherein said first larger arcuate interconnecting portion has a polygonal shape which is approximated by a plurality of straight lines.

9. A deflection yoke device according to claim 1, wherein a thickness of said larger arcuate interconnecting portion in a radial direction is generally equal to a thickness of said longitudinal portions in the radial direction.

10. A deflection yoke device according to claim 4, wherein a thickness of said first larger arcuate interconnecting portion in a radial direction is generally equal to a thickness of said first longitudinal portions in the radial direction.

11. A deflection yoke device according to claim 1, wherein a thickness of said smaller arcuate interconnecting portion in a radial direction is generally equal to a thickness of said longitudinal portions.

12. A deflection yoke device according to claim 4, wherein a thickness of said first smaller arcuate interconnecting portion in a radial direction is generally equal to a thickness of said first longitudinal portions.

13. A deflection yoke device according to claim 2, wherein said cores are arch-shaped to diverge in a longitudinal direction and to be increased in a longitudinal length progressively toward a core peak of each of said cores at a diverging side, and said pair of cores are butted together, with concave sides of said cores opposed to each other, to assume a shape like a bell of a trumpet, and wherein said pair of horizontal deflection coils are butted together with said longitudinal portions opposed to each other, and positions where said longitudinal portions are butted together are registered with positions of said core peaks in a circumferential direction.

14. A deflection yoke device according to claim 5, wherein said cores are arch-shaped to diverge in a longitudinal direction and to be increased in a longitudinal length progressively toward a core peak of each of said cores at a diverging side, and said pair of cores are butted together, with concave sides of said cores opposed to each other, to assume a shape like a bell of a trumpet, and wherein said pair of horizontal deflection coils are butted together with said first longitudinal portions opposed to each other, and positions where said first longitudinal portions are butted together are registered with positions of said core peaks in a circumferential direction.

15. A deflection yoke device according to claim 2, wherein said larger arcuate interconnecting portion has a polygonal shape which is approximated by a plurality of straight lines.

16. A deflection yoke device according to claim 3, wherein said larger arcuate interconnecting portion has a polygonal shape which is approximated by a plurality of straight lines.

17. A deflection yoke device according to claim 13, wherein said larger arcuate interconnecting portion has a polygonal shape which is approximated by a plurality of straight lines.

18. A deflection yoke device according to claim 5, wherein said first larger arcuate interconnecting portion has a polygonal shape which is approximated by a plurality of straight lines.

19. A deflection yoke device according to claim 6, wherein said first larger arcuate interconnecting portion has a polygonal shape which is approximated by a plurality of straight lines.

20. A deflection yoke device according to claim 14, wherein said first larger arcuate interconnecting portion has a polygonal shape which is approximated by a plurality of straight lines.

21. A deflection yoke device according to claim 2, wherein a thickness of said larger arcuate interconnecting portion in a radial direction is generally equal to a thickness of said longitudinal portions in the radial direction.

22. A deflection yoke device according to claim 3, wherein a thickness of said larger arcuate interconnecting portion in a radial direction is generally equal to a thickness of said longitudinal portions in the radial direction.

23. A deflection yoke device according to claim 13, wherein a thickness of said larger arcuate interconnecting portion in a radial direction is generally equal to a thickness of said longitudinal portions in the radial direction.

24. A deflection yoke device according to claim 5, wherein a thickness of said first larger arcuate interconnecting portion in a radial direction is generally equal to a thickness of said first longitudinal portions in the radial direction.

25. A deflection yoke device according to claim 6, wherein a thickness of said first larger arcuate interconnecting portion in a radial direction is generally equal to a thickness of said first longitudinal portions in the radial direction.

26. A deflection yoke device according to claim 14, wherein a thickness of said first larger arcuate interconnecting portion in a radial direction is generally equal to a thickness of said first longitudinal portions in the radial direction.

27. A deflection yoke device according to claim 2, wherein a thickness of said smaller arcuate interconnecting portion in a radial direction is generally equal to a thickness of said longitudinal portions.

28. A deflection yoke device according to claim 3, wherein a thickness of said smaller arcuate interconnecting portion in a radial direction is generally equal to a thickness of said longitudinal portions.

29. A deflection yoke device according to claim 7, wherein a thickness of said smaller arcuate interconnecting portion in a radial direction is generally equal to a thickness of said longitudinal portions.

30. A deflection yoke device according to claim 9, wherein a thickness of said smaller arcuate interconnecting portion in a radial direction is generally equal to a thickness of said longitudinal portions.

31. A deflection yoke device according to claim 13, wherein a thickness of said smaller arcuate interconnecting portion in a radial direction is generally equal to a thickness of said longitudinal portions.

32. A deflection yoke device according to claim 15, wherein a thickness of said smaller arcuate interconnecting portion in a radial direction is generally equal to a thickness of said longitudinal portions.

33. A deflection yoke device according to claim 16, wherein a thickness of said smaller arcuate interconnecting portion in a radial direction is generally equal to a thickness of said longitudinal portions.

34. A deflection yoke device according to claim 17, wherein a thickness of said smaller arcuate interconnecting portion in a radial direction is generally equal to a thickness of said longitudinal portions.

35. A deflection yoke device according to claim 21, wherein a thickness of said smaller arcuate interconnecting portion in a radial direction is generally equal to a thickness of said longitudinal portions.

36. A deflection yoke device according to claim 22, wherein a thickness of said smaller arcuate interconnecting portion in a radial direction is generally equal to a thickness of said longitudinal portions.

37. A deflection yoke device according to claim 23, wherein a thickness of said smaller arcuate interconnecting portion in a radial direction is generally equal to a thickness of said longitudinal portions.

38. A deflection yoke device according to claim 5, wherein a thickness of said first smaller arcuate interconnecting portion in a radial direction is generally equal to a thickness of said first longitudinal portions.

39. A deflection yoke device according to claim 8, wherein a thickness of said first smaller arcuate interconnecting portion in a radial direction is generally equal to a thickness of said first longitudinal portions.

40. A deflection yoke device according to claim 10, wherein a thickness of said first smaller arcuate interconnecting portion in a radial direction is generally equal to a thickness of said first longitudinal portions.

41. A deflection yoke device according to claim 18, wherein a thickness of said first smaller arcuate interconnecting portion in a radial direction is generally equal to a thickness of said first longitudinal portions.

42. A deflection yoke device according to claim 19, wherein a thickness of said first smaller arcuate interconnecting portion in a radial direction is generally equal to a thickness of said first longitudinal portions.

43. A deflection yoke device according to claim 20, wherein a thickness of said first smaller arcuate interconnecting portion in a radial direction is generally equal to a thickness of said first longitudinal portions.

44. A deflection yoke device according to claim 24, wherein a thickness of said first smaller arcuate interconnecting portion in a radial direction is generally equal to a thickness of said first longitudinal portions.

45. A deflection yoke device according to claim 25, wherein a thickness of said first smaller arcuate interconnecting portion in a radial direction is generally equal to a thickness of said first longitudinal portions.

46. A deflection yoke device according to claim 26, wherein a thickness of said first smaller arcuate interconnecting portion in a radial direction is generally equal to a thickness of said first longitudinal portions.

47. A deflection yoke device according to claim 1, having an axis, wherein, in each of the horizontal deflection coils, a distance from the smaller arcuate interconnecting portion to the larger arcuate interconnecting portion increases away from the axis.

48. A deflection yoke device according to claim 2, having an axis, wherein, in each of the horizontal deflection coils, a distance from the smaller arcuate interconnecting portion to the larger arcuate interconnecting portion increases away from the axis.

49. A deflection yoke device according to claim 4, having an axis, wherein, in each of the horizontal deflection coils, a distance from the first smaller arcuate interconnecting portion to the first larger arcuate interconnecting portion increases away from the axis.

50. A deflection yoke device according to claim 5, having an axis, wherein, in each of the horizontal deflection coils, a distance from the first smaller arcuate interconnecting portion to the first larger arcuate interconnecting portion increases away from the axis.

* * * * *